US008443468B2

(12) United States Patent
Minson

(10) Patent No.: US 8,443,468 B2
(45) Date of Patent: May 21, 2013

(54) CERVICAL SPINE PROTECTION COLLAR FOR CONTACT AND NON-CONTACT ACTIVITIES

(76) Inventor: Matthew Alan Minson, Spring, TX (US)

( * ) Notice: Subject to any disclaimer, the term of this patent is extended or adjusted under 35 U.S.C. 154(b) by 0 days.

(21) Appl. No.: 13/385,051

(22) Filed: Jan. 31, 2012

(65) Prior Publication Data

US 2012/0192340 A1 Aug. 2, 2012

Related U.S. Application Data

(60) Provisional application No. 61/457,209, filed on Jan. 31, 2011.

(51) Int. Cl.
*A41D 13/00* (2006.01)

(52) U.S. Cl.
USPC ..... 2/468

(58) Field of Classification Search
USPC ..... 2/468, 455, 2.15, 44, 45, 92, 102, 2/467; 128/95.1, 97.1; 602/5, 18
See application file for complete search history.

(56) References Cited

U.S. PATENT DOCUMENTS

| | | | | |
|---|---|---|---|---|
| 4,501,023 | A | 2/1985 | Bilberry | |
| 4,996,720 | A * | 3/1991 | Fair | 2/462 |
| 5,483,698 | A * | 1/1996 | Douglas, Jr. | 2/462 |
| 5,517,699 | A * | 5/1996 | Abraham, II | 2/425 |
| 5,930,843 | A | 8/1999 | Kelly | |
| 6,006,368 | A * | 12/1999 | Phillips | 2/468 |
| 6,308,345 | B1 * | 10/2001 | Williams, Jr. | 2/468 |
| 6,791,123 | B2 * | 9/2004 | Yamagishi et al. | 257/174 |
| 7,430,767 | B2 * | 10/2008 | Nagely | 2/425 |
| 7,941,873 | B2 * | 5/2011 | Nagely et al. | 2/425 |
| 2004/0098793 | A1 | 5/2004 | Gershenson | |

* cited by examiner

*Primary Examiner* — Tejash Patel
(74) *Attorney, Agent, or Firm* — Davidson Berquist Jackson & Gowdey, LLP

(57) ABSTRACT

The present invention is a collar/harness worn to protect the cervical spine of an active participant when force is applied that would otherwise cause hyperextension, abnormal movement or position, or compression that results in injury, the device (collar-harness) is worn on the shoulders with an anterior (chest interface) portion and a posterior (back interface) portion such that a removable, adjustable coil interfaces with a helmet and the collar via attachment platforms arrayed at the angle of the mandible on either side and at the base of the head to prevent compression and hyperextensions of the cervical spine.

11 Claims, 3 Drawing Sheets

CERVICAL SPINE PROTECTION COLLAR FOR CONTACT AND NON-CONTACT ACTIVITIES

CROSS-REFERENCE TO RELATED APPLICATIONS

This application claims benefit to U.S. Provisional Application No. 61/457,209 filed Jan. 31, 2011, the entire contents of which are incorporated herein by reference.

FIELD OF THE INVENTION

The present invention relates generally to protective apparel, and more specifically to a device worn to protect the cervical spine (neck) form injury during various contact and non-contact activities.

BACKGROUND OF THE INVENTION

Sports injuries are injuries that typically occur while participating in organized sports, competitions, training sessions, or organized fitness activities. The U.S. Consumer Product Safety Commission (CPSC) tracks product-related injuries through its National Injury Information Clearinghouse. According to the CPSC, there were an estimated 309,322 sports-related head injuries treated at U.S. hospital emergency rooms in 2005. Bruce reports that 80% of severe sports-related central nervous system trauma occurs as a result of collision sports, chiefly American football and rugby union football, followed by wrestling and gymnastics. Additionally, contact sports such as skiing, hockey, and motocross carry additional high propensities for cervical spinal injury. Naturally, the actual incidence of head injuries is potentially much higher, as many of these injuries are treated in the prehospital setting, at physician's offices, immediate care centers, or self-treated.

Sports and recreational activities contribute to about 21 percent of all traumatic brain injuries among American children and adolescents. The top 10 head injury categories among children ages 14 and younger are i) Cycling, ii) Football, iii) Baseball and Softball, iv) Basketball, v) Water Sports, vi) Skateboards/Scooters, vii) Powered Recreational Vehicles, viii) Winter Sports, ix) Soccer, x) Trampolines.

One of the most challenging roles of the team physician involves the intervention and decision-making processes regarding cervical spine (C-spine) injuries in contact sports. See: http://www.emedicine.com/orthoped/byname/cervical-spine-injuries-in-sports.htm.

C-spine injuries have been reported in most contact sports, including football, hockey, rugby, and wrestling, and in several non-contact sports, such as skiing, gymnastics, track and field, diving, surfing, power lifting, and equestrian events. C-spine injuries are estimated to occur in 10-15% of all football players, most commonly in linemen and defensive players. Serious injuries with neurologic sequelae remain infrequent, and most of these injuries are self-limited. Injuries occur in all levels of play, from the high school to the professional level.

The natural architecture of the normal C-spine assumes a lordosis of the vertebrae. This lordosis allows for controlled motion and the transmission of forces to the supporting muscles and soft tissues. When the neck is slightly flexed, approximately 30°, the normal lordosis is straightened, and the forces of the axial load are transmitted to the bones and disks. If the impact force is greater than the yield strength of the vertebrae, a fracture and possible dislocation with cord injury can occur.

The cervical spine between the skull and first body (antlanto-axial interface, C-1.) of the thoracic vertebra is the most vulnerable area to force in athletics and high impact endeavors. This portion of the spine is especially vulnerable to two types of injury producing injurious force movements. The first is compression, in which a dynamic force is applied to the crown of the head or helmet. As a direct result, the cervical spine is compressed, which results in injury. The second mechanism is hyperextension, in which a lateral force (angled, oblique, or horizontal) displaces the head from one side to the other, or from the front-to-back (antero-posterior [A-P] displacement). The A-P displacement is one of the more common injury mechanisms for which there is currently no preventive measure.

Presently known prior art includes the following:

United States Patent Application Publication No. US 2004/0098793 A1, which as published on May 27, 2004 for Gershenson, entitled "Protective trauma device straps for helmets." It relates to a retention system in sport helmets, having a strap with a concave under chin oval protective trauma device embodiment, attached and member to chinstrap of helmet. A horizontal Velcro strap has a curved concave under the occipital protuberance protective trauma device embodiment, which is attached and member to the rear distal Y lateral straps of the helmet.

However, the Gershenson is merely an improved chinstrap for a helmet. In contrast, the present invention is different in that it is a device (collar-harness) worn to protect the cervical spine (neck) from injuries due to compression and hyperextensions of the cervical spine from various physical activities.

U.S. Pat. No. 5,930,843, entitled "Helmet and shoulder harness assembly providing cervical spine protection" and issued to Kelly on Aug. 3, 1999, is a cervical spine protective helmet and shoulder harness assembly that includes a yoke or shoulder pad having a central opening for the wearer's head to pass there through; accurate tracks allow the head of the wearer to be turned from side to side; neck compression is limited by the rigidity of the uprights supporting the helmet.

However, the Kelly invention is merely a bolt-on brace and seriously limits rotation. For example, by limiting rotation, the Kelly invention may actually make the wearer more vulnerable to blind side injury; therefore, it has no practical application to contact and non-contact activities. In contrast, the present invention is different in that it is a device (collar-harness) worn to protect the cervical spine (neck) from injuries due to compression and hyperextensions of the cervical spine from various physical activities.

U.S. Pat. No. 4,501,023, entitled "Neck Support" and issued to Bilberry on Feb. 26, 1985, is a neck support for use in contact sports, which includes a resilient, yieldable collar having at least one front support extending downwardly from the collar beneath an athlete's chin, and attached to his shoulder harness or pads. The collar intercepts the chin, and the collar and front support together prevent downward movement of the athlete's head past a predetermined position to prevent undesirable hyper-flexure of the cervical vertebrae and damage to the cervical spine, responsive to a blow or blows delivered to the athlete's head.

The Bilberry invention is a static device that is not adjustable to varying lengths of individual necks. Also in the Bilberry invention, there is no assurance of alignment, and it utilizes the chin as a point of reference, which could restrict movement. If the Bilberry neck support is worn under the shoulder pads, then it has no attachment capacity and requires perfect static fitting, which would be compromised by movement of the wearer. Because the Bilberry neck support compresses, it thus has a variability to it that may have inadequate protection from certain and likely forces encountered in contact and non-contact activities.

However, in contrast, the present invention is different in that it is not a static device, but a dynamic one because it has adjustable fittings for varying lengths of individual necks. Unlike the Bilberry invention, in the present invention there is an assurance of alignment because of an attachment, and the present invention does not restrict movement because it does not utilize the chin as a point of reference. Because of these differences in structure, the present invention is significantly more effective from compression and hyperextensions of the cervical spine than the Bilberry invention.

U.S. Pat. No. 4,338,685, entitled "Cervical Collar" and issued to LaPorta on Jul. 13, 1982, is a cervical collar that attaches to a shoulder pad harness to reduce the size of the neck opening and to elevate the neck opening. The collar includes a pair of arched cantilevers which are connected by a small plate and padded around the edges defining the neck opening. The helmet contacts the edge of the neck opening in the collar to limit flexing of the neck such that excessive lateral cervical flexion and hyperextension of the neck are prevented.

A closer analysis of the LaPorta invention reveals that it is worn over the shoulder pads, which subjects it to mechanical shifting of the pads which, in turn, renders the invention less effective for its intended purpose. It does not have the capacity to account for varying lengths of individual neck sizes. The LaPorta invention also depends on a present alignment such that if any shift occurs, then such shift may increase the potential for a misalignment which, in turn, could render the LaPorta invention at least of no value and at most a resultant harmful vector of force.

However, the present invention is different in that it is worn under the shoulder pads and allows a superior transmission of compression force from the vulnerable neck/cervical spine region to the upper torso. Because it is placed under the shoulder pads, it is not subject to the same shift and misalignment as the LaPorta invention. Furthermore, the present invention has an attachment mechanism of the coil attachments to the helmet to prevent disengagement, and can prevent compression of the spine due to direct vertical force applied to the crown of the head. The LaPorta invention does not even address this injury mechanism.

Furthermore, the LaPorta invention is static in design, whereas the present invention is dynamic in using flattened coils, which allows non-limiting rotation of the head and neck while still providing the needed and intended compression and hyperextension protection. The intended protection of the LaPorta invention would be nullified in certain rotation movements, such as when an active wearer swivels her head on her neck to look over her shoulders to catch a pass, etc.

Neck injuries are an unavoidable part of the contact sports, non-contact sports, training sessions, or organized fitness activities. While the aforementioned devices and the like may fulfill their respective, particular objectives and requirements, the need still remains for a protective device that would oppose cervical compression of the spine, side-to-side displacement of the head, and cervical antero-posterior hyperextension.

The present invention is a device worn under a set of shoulder pads against the body and interfacing with a helmet to protect the cervical spine (neck) of a participant when force is applied that would otherwise cause hyperextension, abnormal movement or position, or compression that results in injury.

SUMMARY OF THE INVENTION

In view of the preceding, it is an object of this present invention to provide protection against spinal hyperextension injuries laterally and posteriorly.

It is another object of the present invention to prevent compression injuries in which force is applied to the crown (top) of the helmet.

It is another object of the present invention to provide a device or collar in which there is a quadrilateral transfer of force from the neck and spine to the shoulders and torso so as to reduce injury.

It is another object of the present invention to provide a device or collar designed to allow rotational freedom of the neck so that performance of the athlete or wearer is maintained.

It is another object of the present invention to provide a device or collar designed to allow it to be worn below (or under) the shoulder pads or garments in a way not to interference with comfort or function.

It is another object of the present invention to provide a device or collar that can be worn or attached to the base of the skull (posterior attachment) to prevent posterior hyperextension alone.

It is another object of the present invention to provide a device or collar that can be easily removed or replaced.

It is another object of the present invention to provide a device or collar such that the coil attachment can be removed without removing the collar-harness to facilitate removal of a helmet without having to remove the entire collar.

It is another object of the present invention to provide a device or collar in which the material cover to each of the coil portions of the coil attachment is worn over the coils to prevent grass, foreign material, etc. from being introduced into the coil and to stabilize the coil.

It is another object of the present invention to provide a device or collar that is adjustable to varying lengths of individual necks.

It is another object of the present invention to provide a device or collar that has an assurance of constant alignment for constant protection of the cervical region.

It is another object of the present invention to provide a device or collar that allows a superior transmission of compression force from the vulnerable neck/cervical spine to the upper torso.

It is another object of the present invention to provide a device or collar that has an attachment mechanism of the coil attachments to the helmet to prevent disengagement.

It is another object of the present invention to provide a device or collar that prevents compression of the spine due to a direct vertical force applied to the crown of the head.

It is another object of the present invention to provide a device or collar that utilizes flattened coils, which allow rotation of the head and neck and still provide compression and hyperextension protection.

In satisfaction of these and related objectives, the present invention is a device (collar-harness) worn to protect the cervical spine (neck) from injuries due to compression and hyperextensions of the cervical spine from various physical activities.

BRIEF DESCRIPTION OF THE DRAWING

The following drawings are illustrative of the invention and are not meant to limit the scope of the invention as encompassed by the claims:

DETAILED DESCRIPTION OF THE INVENTION

Figure 1:
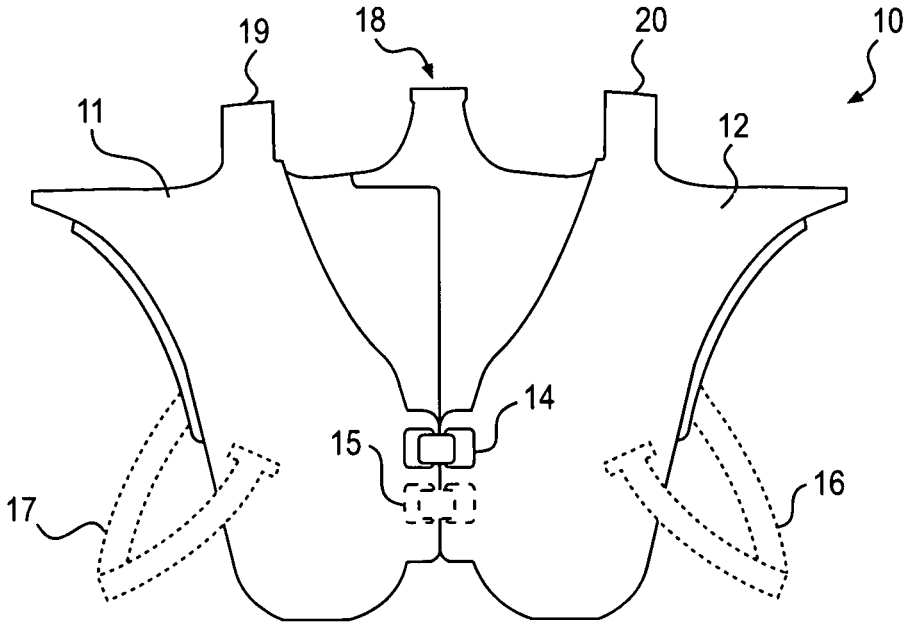
FIG. 1 is a frontal view of the safety collar of a preferred embodiment of the present invention.

The description of the present invention will illustrate specific terminology for the sake of clarity. However, the invention is not intended to be limited to the specific terminology so selected, and it is to be understood that this invention will have a wide range of applications.

The Cervical Spine Protection Collar or Harness of the present invention is worn on the shoulders, long with an anterior (chest interface) portion and posterior (back interface) portion such that a removable, adjustable coil interfaces with a helmet and the collar via attachment platforms arrayed at the angle of the mandible (position on the helmet) on either side and at the (occipital region) base of the head. Such an architecture effectively prevents compression and hyper-extensions of the cervical spine without limiting movement of the individual during contact and contact activities.

The platforms provide an interface for a locking attachment with a built-in relaxed, completely compressed coil that also snaps onto the platform and the helmet on three axes, specifically, under the "ear" angle on both sides of the head and at the base of the posterior aspect of the helmet. This provides protection against spinal hyperextension injuries laterally and posteriorly. These platforms, which are based on the height of the attached coils, also prevent compression injuries in which force is applied to the crown (top) of the helmet. The "arch" design of the platform to the remainder of the collar allow the collar harness to be worn under or below shoulder pads or garments without interference of comfort of function. The locking mechanism of the coil attachment with the platform prevents inadvertent release.

The detachable coils are specifically designed to permit the coils of each spring to slide relative to one another, creating a spring force as the wearer rotates his head. This slippage, and resulting spring force, allows rotational freedom of the neck but also provides a force to restore the original orientation of the helmet. The coil attachment can be removed without removing the collar-harness to facilitate removal of a helmet without having to remove the entire collar. Such neck freedom does not hinder the performance of the athlete or wearer nor hinder the potential protection of the mechanisms of injury. Furthermore, the adjustable or interchangeable nature of the attached coils allows tailoring to the wearer.

The design of the collar-harness resting on the shoulders chest and back provides a quadrilateral transfer of force from the neck and spine to the shoulders and torso and thereby effectively reducing injury. The collar-harness is a bivalve design with snaps in the front and a pin-in hinge design in the back to allow ease of removal and replacement. The collar-harness can be worn with a single coil attachment at the base of the skull (posterior attachment) to prevent posterior hyperextension alone.

The key lock between the platform and the coil attachment is a "male" interface on the platform and a "female" shaped receptacle that allows a "locking turn" and is held in place by a snap. The snap is a redundant security measure to prevent inadvertent release. The underarm shoulder strap is adjustable to the collar-harness so that it can be tailored to the wearer.

A material cover to each of the coil portions of the coil attachment is worn over the coils to prevent grass, foreign material, etc. from being introduced into the coil and to stabilize the coil.

DETAILED DESCRIPTION OF THE PREFERRED EMBODIMENT

Figure 2:
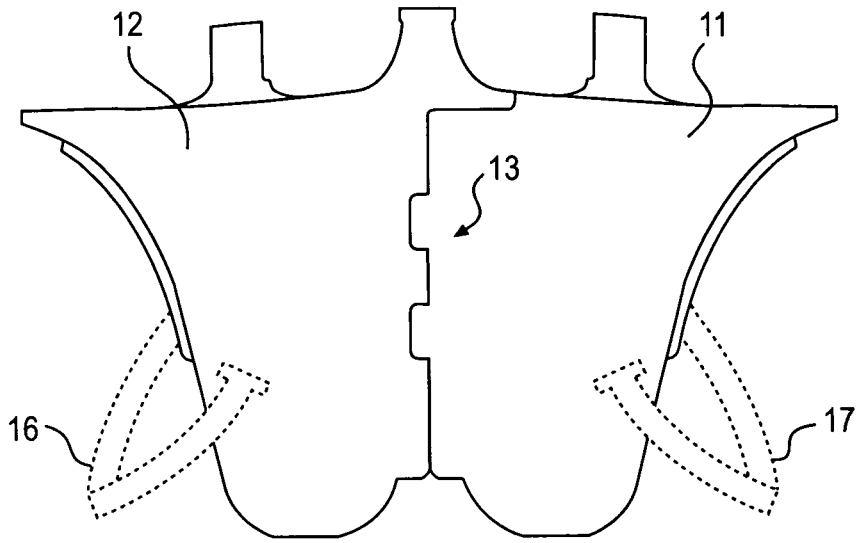
FIG. 2 is a rear view of a preferred embodiment of the present invention.

As shown in FIG. 1, the protection collar 10 of the preferred embodiment of the invention is comprised of two halves, a right half 11 and a left half 12. The protection collar 10 is designed to be worn, in the preferred embodiment, adjacent a wearer's shoulders and chest (not shown) under shoulder pads (not shown). In use, the two halves 11 and 12 are connected by a hinge (shown in FIG. 2 as 13) on back side of the collar 10 and snap connectors 14 and 15 on the front side of the collar. The wearer places the collar 10 in position on her body, rotates the two halves 11 and 12 together, such that they can be snapped together in position by snap connectors/latches 14 and 15. Adjustable arm straps 16 and 17 (shown in dotted lines) hold collar 10 in place and reduce movement of collar 10 away from a wearer's body. The materials suitable for use for the two collar halves 11 and 12, the hinge 13, the snap connectors 14 and 15 and the adjustable arm straps 16 and 17 are known to those of skill in the art. The collar 10 includes mounting platform 18, positioned at the posterior portion of the collar 10 to support a user's helmet (not shown in FIG. 1 or 2). In a preferred embodiment of the invention, mounting platform 19 is formed on collar half 11 and mounting platform 20 is formed on collar half 12. Mounting platforms 19 and 20 can be used to support opposite sides of a user's helmet (not shown in FIG. 1 or 2) to limit side-to-side movement of the user's head so as to avoid hyperextension of the neck from side-to-side.

Figure 3:
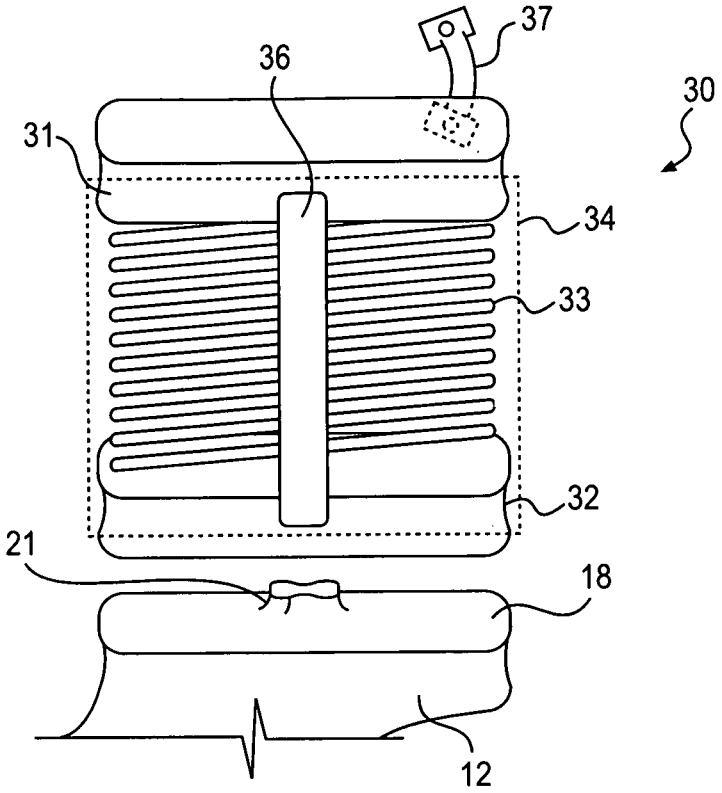
FIG. 3 is a partial cross-sectional side view of the connector coil assembly of a preferred embodiment of the present invention.

FIG. 3 illustrates a preferred embodiment of a connector coil assembly 30. Connector coil assembly is designed to mount between mounting platform 18 of collar 10 (shown at the bottom of FIG. 3) and a user's helmet (not shown in FIG. 3). The connector coil assembly 30 includes a top mounting plate 31, a single coil 33, wrapped in a protective sleeve 34 (shown in cross-section by dotted line), and a bottom mounting plate 32. Strap 36 connects the top mounting plate 31 and bottom mounting plate 32. Strap 36 may be made of elastic material or a cloth encased coil spring. Bottom mounting plate 32 is sized and shaped to be supported by collar mounting platform 18. The connector coil assembly 30 is designed to mount to collar 10 via a hour-glass shaped male key lock 21 formed on the collar mounting platform 18 via a hour-glass shaped female key lock receptacle 35 (shown in FIG. 4) formed in the bottom mounting plate 32. Connector coil assembly 30 is further secured in place by helmet attachment strap 37 and, collar attachment strap 38 (shown in FIG. 5). Attachment strap 38 connects with snap 39 on mounting platform 18. The attachment straps 37 and 38 can utilize any of the known connection methods including push button snaps or Velcro fasteners. The attachment straps 37 and 38 serve to hold the connector coil assembly 30 in place between the user's helmet (not shown) and the during use, but facilitate removal of the helmet when not needed such as when the user in not on the field.

In a preferred embodiment of the invention, the coil 33 is a flat spring in which the coils rest against each other in the relaxed state and are thus substantially resistant to compression, and thus transfer axial loads from the user's helmet to the user's torso. The coil 33 is, however, capable of facilitating some lateral, side-to-side, slippage of so as to allow the user to rotate her head. When rotated is such a manner, coil 33 creates a spring force which urges the user's head to rotate back to its initial orientation. The height of the coil 33, as well as the top and bottom mounting plates 31 and 32 can be customized to suit the user's body, in particular the neck length, to be comfortable while promoting neck and spinal cord safety.

Figure 4:
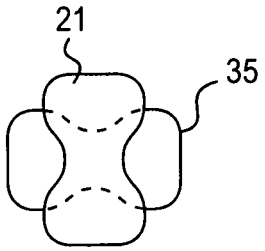
FIG. 4 is a top-view of the key lock of the platform to spring/coil mechanism the present invention.
Figure 5:
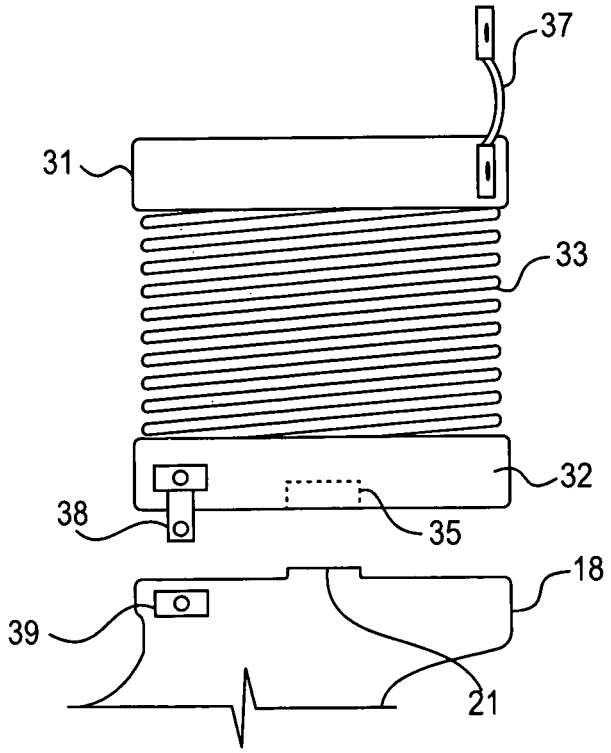
FIG. 5 is a side view of a connector coil assembly and a connector coil mounting platform of a preferred embodiment of the present invention.

As shown in FIG. 4, the hour-glass shaped key lock 21 and mating key lock receptacle 35 provide the primary mechanism between the connector coil assembly 30 and the collar 10. The connector coil assembly 30 is placed on the platform 18, matching female key lock receptacle 35 to the male key lock 21, and then turned 45 degrees locking them together. A snap connector 38 extending from the bottom mounting plate 32 of connector coil assembly 30 is mated to the snap attachment 39 on mounting platform 18 to provide a redundant locking mechanism. These connections are shown in FIG. 5. FIG. 5 also depicts a snap connector 37 which can be used to attach top mounting plate 31 to the user's helmet (not shown).

Figure 6:
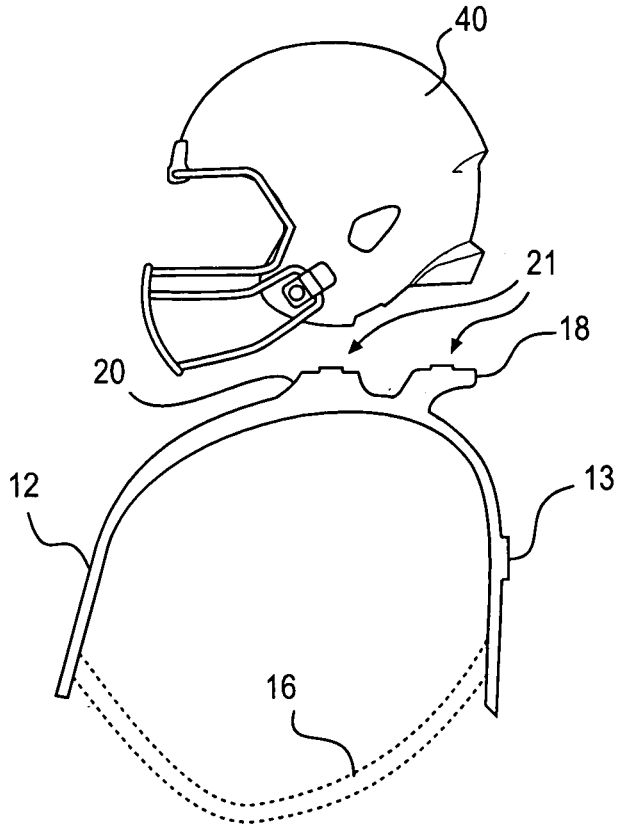
FIG. 6 is a side-view of an embodiment of the present invention when unloaded.

In a first preferred embodiment of the invention, only one platform and connector coil assembly are utilized as the back of the head. In that embodiment, only mounting platform 18 and one connector coil assembly 30 is utilized. That embodiment of the invention will reduce forward and backward hyperextension of the neck and will facilitate transfer of axial loads on the head to the protection collar 10, and thus from the user's head and neck to the torso. In another preferred embodiment of the invention, three mounting platforms 18, 19, and 20, are used. One, mounting platform 18 is provided at the back of the neck (helmet), and a mounting platform, 19 and 20, are provided on each side of the head at the angle of the mandible below the ear extensions of the helmet. In this preferred embodiment, all platforms 18, 19, and 20 are provided with their own connecting coil assembly 30, all function similarly, and they all attach to the helmet similarly. These additional connector coil assemblies, like the one mounted to mounting plate 18, permit rotation of the user's head and create a spring force urging the return of the user's head to its original orientation. The position and orientation of the components in an unloaded state are shown in FIG. 6.

Figure 7:
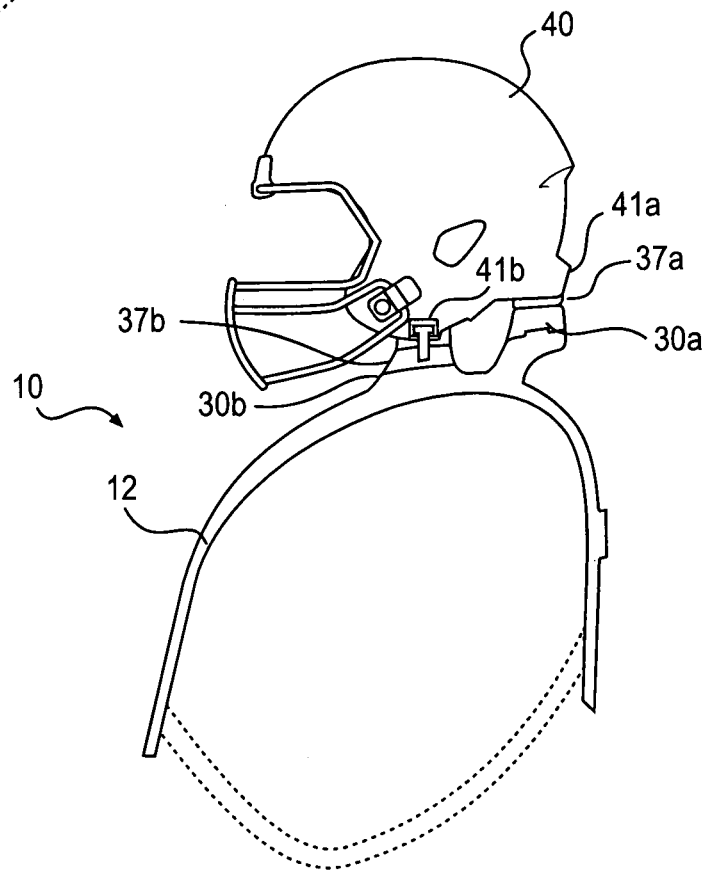
FIG. 7 is a side-view of an embodiment of the present invention when loaded.

FIG. 7 illustrates the attachment of helmet 40 to protection collar 10 through connector coil assemblies 30*a* (back) and 30*b* (left side). The helmet 40 is held in fixed position via attachment straps 37*a* and 37*b* connecting with snap connectors which connect to snaps 41*a* and 41*b*. The safety collar of the present invention is loaded when the connector coil assemblies 30 are locked to the platform 18 via the key lock 21, 35 and attachment straps 38, and the connector coil assemblies 30 are connected to helmet 40 via attachment straps 37. The safety collar of the present invention is unloaded when they are not. All of the connector coil assemblies 30 attach to the three respective platforms 1, 19 and 20 the same way and they all have a protective sheath or sleeve 34 to prevent foreign material from getting into the coil 33. The sheath serves to prevent grass and other foreign material from compromising the mechanism or function of the coil.

Although not part of the invention, the player's protective gear can include shoulder pads which are illustrated in dotted line in FIG. 7. As shown in FIG. 7, the protective collar of an embodiment of the present invention can be worn under the player's shoulder pads to as to allow an axial force applied to the top of the player's helmet to be transmitted to the player's torso so as to minimize force applied to the cervical spine and neck. The top of each connector coil assembly engages with a complementary engagement surface on the bottom of helmet 40 (not shown). Helmet straps 37 do not impede rotation, but do not enhance rotation. They provide assurance of communication between the helmet and the top plate of the spring mounted platforms on the collar 10.

In use, the protection collar 10 opens in a clamshell fashion via hinge 13, is applied to the wearer's body such that the wearer's arms extend through the adjustable arm straps 16 and 17, the collar is closed, and then secured via the snap connectors/latches 14, 15. The connector coil assemblies 30 can be attached to the collar 10 before the collar is placed on the wearer or after. The collar 10 is put on the wearer before the shoulder pads are applied, if shoulder pads are worn in that sport. The wearer can then place his helmet 40 on his head and attach the connective attachment straps 37 for play. These attachment straps allow the wearer to remove the helmet when not needed. It is through the use of collar 10, the connector coil assemblies 30, and attachment to the helmet 40 that excessive axial force applied to the top of the head can be transferred to the wearer's upper torso minimizes the compressive forces applied to the vulnerable neck and the hyperextension of the neck to the back or side to side is minimized.

Various aspects of the different embodiments can be combined in different combinations to create new embodiments. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed:

1. A cervical spine protection collar for use with a protective helmet comprising:

a shoulder platform designed to be worn adjacent a user body and having at least one mounting plate;

a connecting coil spring assembly, said coil spring assembly having a top and a bottom, said coil spring assembly bottom adapted to engage with said at least one shoulder platform mounting plate and said coil spring assembly top adapted to engage with said protective helmet, said coil spring assembly further including a flat coil spring positioned between said top and said bottom, said flat coil spring having a plurality of flat coils;

wherein said plurality of flat coils of said flat coil spring are in contact with one another in a relaxed state such that said flat coil spring resists compression in an axial direction but permits radial slippage of said coils to facilitate rotational movement of said protective helmet relative to said cervical spine protection collar.

2. The cervical spine protection collar of claim 1, wherein said collar is designed to reduce injuries to a helmet wearing player by reducing forceful anatomical hyperextension, front to rear, and compression of player's cervical spine.

3. The cervical spine protection collar of claim 1, wherein said collar further comprising a male lock key attachment component on said at least one mounting plate and a corresponding female lock key receptacle component in said coil spring assembly bottom.

4. The cervical spine protection collar of claim 1, further comprising a snap attachment connector attaching said at least one mounting plate to said coil spring assembly wherein said coil spring assembly is removably attached to said mounting plate.

5. The cervical spine protection collar of claim 1, wherein said collar is designed to reduce injuries to a helmet wearing player by reducing forceful anatomical hyperextension, front to rear, and laterally of player's cervical spine.

6. The spine protection collar of claim 1, wherein said connecting coil assembly includes a coil spring arranged to be relaxed and flattened against itself and is positioned on the shoulder platform mounting plate so as to reduce injuries to a helmet wearing player by reducing displacement of a wearer's neck due to limiting forceful anatomical hyperextension and direct compression of the wearer's cervical spine without blocking atlanto-axial rotation of the wearer's head and neck.

7. The spine protection collar of claim 6, wherein said coil spring slides upon itself to facilitate head and neck rotation.

8. The protection collar of claim 7, wherein the coil spring is encased in a protection membrane to prevent foreign material from fouling the spring and compromising the smooth rotation tolerance.

9. The spine protection collar of claim 8, wherein size of the coil spring can be adjusted to fit individual wearers.

10. A cervical spine protection collar for use with a protective helmet comprising:

a shoulder platform designed to be worn adjacent a user body and having three mounting plates;

a connecting coil spring assembly for each of said mounting plates, each of said coil spring assemblies having a top and a bottom, said coil spring assembly bottom adapted to engage with said at least one shoulder platform mounting plate and said coil spring assembly top adapted to engage with three engagement areas on said protective helmet, each of said coil spring assemblies further including a flat coil spring positioned between said top and said bottom, said flat coil having a plurality of flat coils;

wherein said flat coils of each of said flat coil springs are in contact with one another in a relaxed state such that said flat coil spring resists compression in an axial direction but permits radial slippage of said coils to facilitate rotational movement of said protective helmet relative to said cervical spine protection collar.

11. The cervical spine protection collar of claim 10, wherein two of said three engagement areas of said protective helmet are positioned on either side of said helmet to limit side to side hyperextension of a wearer's neck and one of said engagement areas is positioned at a back portion of said helmet to limit rearward hyperextension of said wearer's neck.

* * * * *